US006227269B1

(12) United States Patent
Choe

(10) Patent No.: US 6,227,269 B1
(45) Date of Patent: May 8, 2001

(54) HEAD COVER FOR GOLF CLUBS

(76) Inventor: Jin Tae Choe, San 192, Sampeung APT22-1205, Seocho-Dong, Seocho-Ku, 137-070 Seoul (KR)

( * ) Notice: Subject to any disclaimer, the term of this patent is extended or adjusted under 35 U.S.C. 154(b) by 0 days.

(21) Appl. No.: 09/368,171

(22) Filed: Aug. 5, 1999

(30) Foreign Application Priority Data

Aug. 5, 1998 (KR) ..... 98-31876

(51) Int. Cl.[7] ..... B65D 65/02
(52) U.S. Cl. ..... 150/160; 206/315.2
(58) Field of Search ..... 206/315.2, 315.3, 206/315.4; 150/154, 160

(56) References Cited

U.S. PATENT DOCUMENTS

| | | | | |
|---|---|---|---|---|
| 232,067 | * | 9/1880 | Rosenzweig | 220/602 |
| D. 374,051 | * | 9/1996 | Sheppard, Jr. | D21/221 |
| 2,128,546 | * | 8/1938 | Venmore | 206/315.2 |
| 2,879,819 | * | 3/1959 | Turnbull | 206/315.4 X |
| 3,664,399 | * | 5/1972 | Neff | 206/315.2 |
| 3,707,279 | * | 12/1972 | Kaiser | 206/315.4 |
| 3,901,299 | * | 8/1975 | Picco | 206/315.4 |
| 4,497,404 | * | 2/1985 | Lowrance | 206/315.4 X |
| 4,606,050 | * | 8/1986 | Suk | 150/160 |
| 4,932,523 | * | 6/1990 | Yamazoe | 206/315.6 |
| 5,209,280 | * | 5/1993 | Gevas | 150/159 |

* cited by examiner

*Primary Examiner*—Allan N. Shoap
*Assistant Examiner*—Tri M. Mai
(74) *Attorney, Agent, or Firm*—McDermott, Will & Emery

(57) ABSTRACT

A head cover for golf clubs is disclosed. In the head cover, a tubular member defines a head pocket therein to receive a club head, with first and second openings being formed at both ends of the tubular member. A cap member is detachably mounted to the first opening of the tubular member to close the first opening. A guide member is detachably mounted to the second opening of the tubular member. The guide member is expandable and contractible, thus guiding entrance and exit of the head relative to the head pocket and protecting the head end portion of the shaft. In the guide member, a ring is integrated with a shaft protection part and is mounted to the second opening of the tubular member. The tubular member has a shape retaining frame, with a cloth part provided on the internal and external surfaces of the frame. The cap member has a cap frame having a window, with a cloth part provided on the cap frame for covering interior and exterior surfaces of the cap frame. In the head cover, the shape retaining frame, the cap frame, and the shaft ring are simply and easily produced through an injection molding process.

8 Claims, 5 Drawing Sheets

HEAD COVER FOR GOLF CLUBS

BACKGROUND OF THE INVENTION

1. Field of the Invention

The present invention relates, in general, to head covers for golf clubs and, more particularly, to an improvement in such head covers to allow the head covers to be easily and simply produced and to always maintain its desired stable shape.

2. Description of the Prior Art

When carrying golf clubs, such as woods and irons, on a golf course or other areas, a golfer takes a golf bag with the clubs being received in the bag. In such a case, the clubs are positioned within the bag in a way such that the heads are directed upwardly, with the grips being position on the bottom of the bag. Therefore, the club heads may undesirably strike against each other, and so the heads, particularly, the heads of the woods may be impacted and damaged. In an effort to protect the heads of the woods from being impacted or damaged, it is preferable to cover them with head covers.

A conventional head cover comprises a head protection part, which defines a head pocket for receiving and protecting the head of a club. An elongated shaft protection part integrally extends from the bottom of the head protection part to a length and is used for receiving and protecting the shaft of the club.

In a conventional head cover, the head protection part and the shaft protection part may be integrally formed through a knitting process. However, such a knitted head protection cover is problematic in that it is difficult to maintain the desired shape of the cover for a lengthy period of time due to the intrinsic characteristics of knit.

In an effort to overcome the above problem experienced in the knitted head cover, a head cover of FIG. 1 is proposed and used. In the head cover of FIG. 1, the outer layer 3 of the head protection part 2 is made of cushionable raised fabric, such as woven fabric or synthetic fabric, with a sponge 4 being integrated with the interior surface of the outer layer 3 to maintain a desired shape of the head protection part 2. A shaft protection part 5 is integrated with the bottom of the head protection part 2 through a sewing process.

However, the head cover of FIG. 1 is problematic in that the cover has to be produced through a sewing process, and so it is difficult to make the cover. That is, the sewing process of making such head covers can be only performed by highly skilled workers, and due to the fact that the production process of the head covers is complicated and consumes significant time, productivity is reduced and there is an increase in the production cost of the head covers.

In addition, the integration of the sponge 4 with the cushionable raised fabric of the outer layer 3 may be gradually reduced, or the sewn parts of the head cover may be damaged after the head covers are used for a lengthy period of time. In such a case, it is almost impossible to retain the desired stable shape of the head cover, and so the market competitiveness of the head covers is reduced.

SUMMARY OF THE INVENTION

Accordingly, the present invention has been made keeping in mind the above problems occurring in the prior art, and an object of the present invention is to provide a head cover for golf clubs, which is designed to allow various types of head covers to be easily and simply produced and to maintain its desired stable shape for a lengthy period of time regardless of external impact.

In order to accomplish the above object, the present invention provides a head cover for receiving and protecting both a head and a head end portion of a shaft of a golf club, comprising: a tubular member defining a head pocket therein to receive the head, with first and second openings being formed at both ends of the tubular member; and a cap member detachably mounted to the edge of the first opening of the tubular member, thus closing the first opening.

In the above head cover, a guide member is detachably mounted to the edge of the second opening of the tubular member. The guide member is expandable and contractible, thus guiding entrance and exit of the head relative to the head pocket and protecting the head end portion of the shaft.

The guide member preferably comprises a shaft protection part designed to be expandable and contractible so as to guide the entrance and exit of the head relative to the head pocket and to receive and protect the head end portion of the shaft. A shaft ring is integrated with the shaft protection part and is detachably mounted to the edge of the second opening of the tubular member.

The above shaft ring is also brought into frictional contact with the edge of the second opening.

On the other hand, the tubular member, the cap member and the guide member may be integrally formed in a single structure through an injection molding process using at least one of Styrofoam, foam and/or plastic.

The tubular member preferably consists of a shape retaining frame detachably assembled with the cap member to define the head pocket therein while retaining both a desired size and a desired shape of the head pocket. A cloth part is provided on at least one of internal and external surfaces of the frame.

In the above tubular member, the shape retaining frame preferably consists of a first annular frame part used for forming the first opening of the tubular member while retaining a shape of the first opening. A second annular frame part forms the second opening of the tubular member while retaining the shape of the second opening. At least one connection part connects the first and second annular frame parts to each other while retaining positions of the two frame parts.

The cap member preferably consists of a cap frame assembled with the edge of the first opening of the tubular member by being brought into frictional contact with the edge of the first opening, with a window being provided on the cap frame for allowing the interior of the tubular member to be observable from the outside of the cap member. A cloth part is provided on the cap frame for covering interior and exterior surfaces of the cap frame.

In the above cap member, the window is preferably made of a transparent material.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
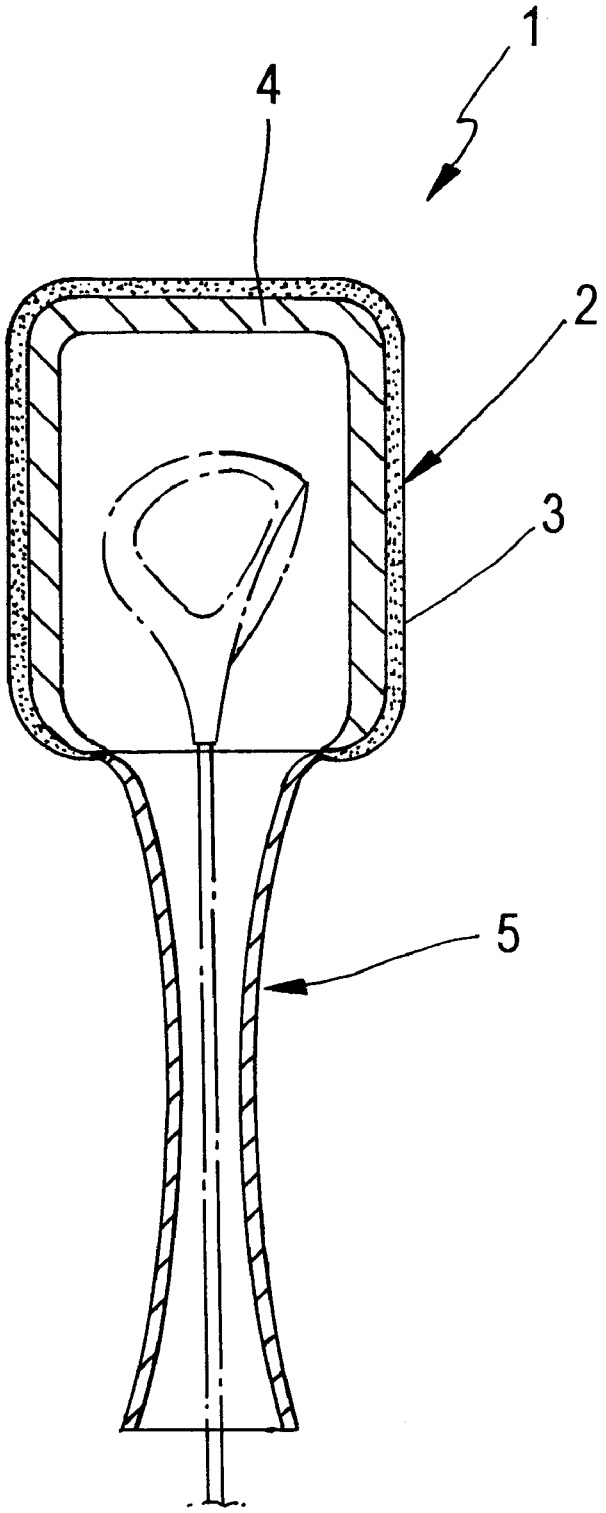
FIG. 1 (PRIOR ART)
FIG. 1 is a longitudinal-sectioned view of a conventional head cover for golf clubs.
Figure 2:
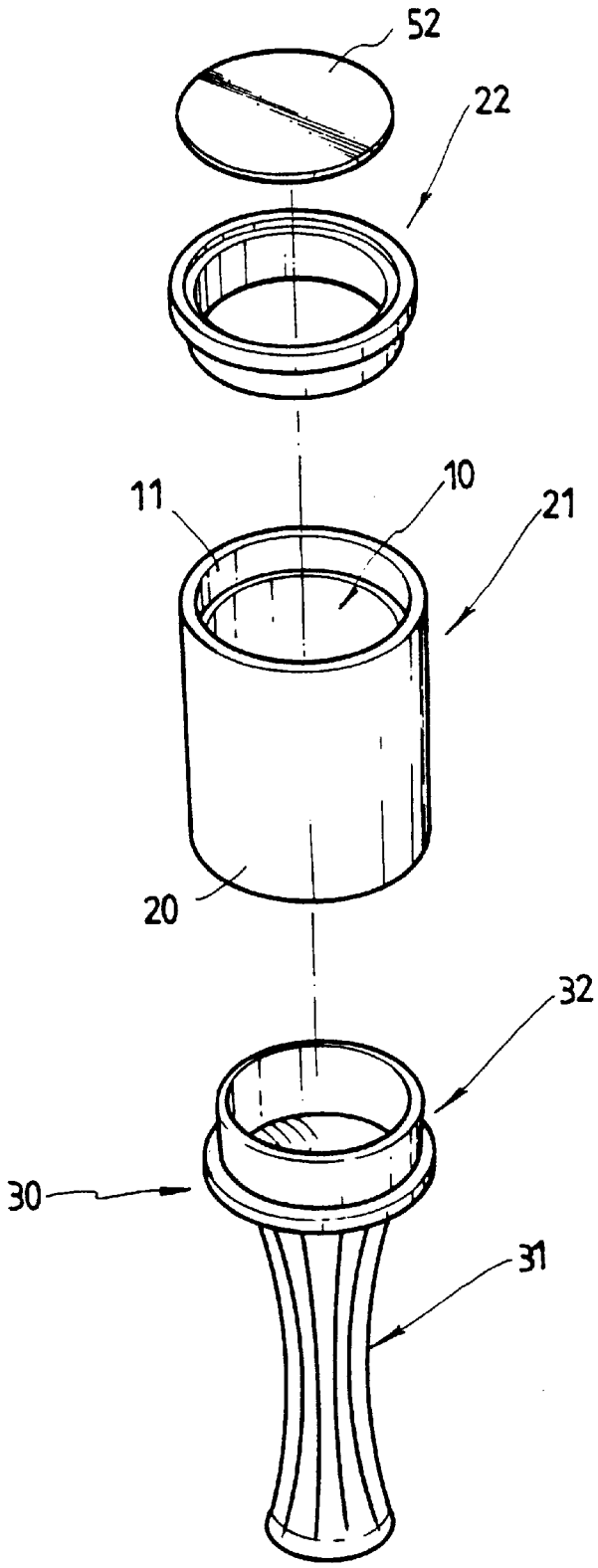
FIG. 2 is an exploded perspective view, showing the order of assembling the parts of a head cover according to the primary embodiment of this invention.
Figure 3:
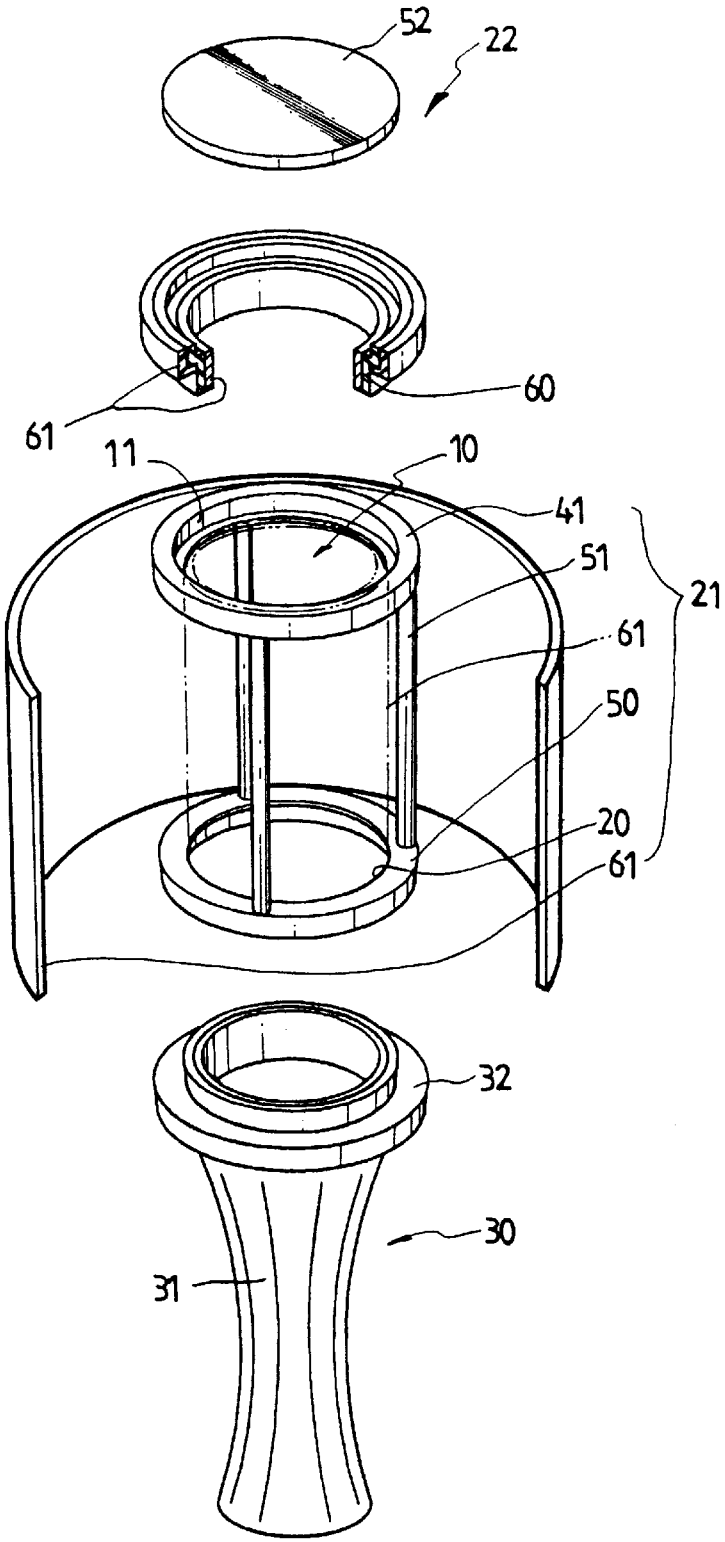
FIG. 3 is a partially broken perspective view of a tubular member of the head cover of FIG. 2.
Figures 4, 4A:
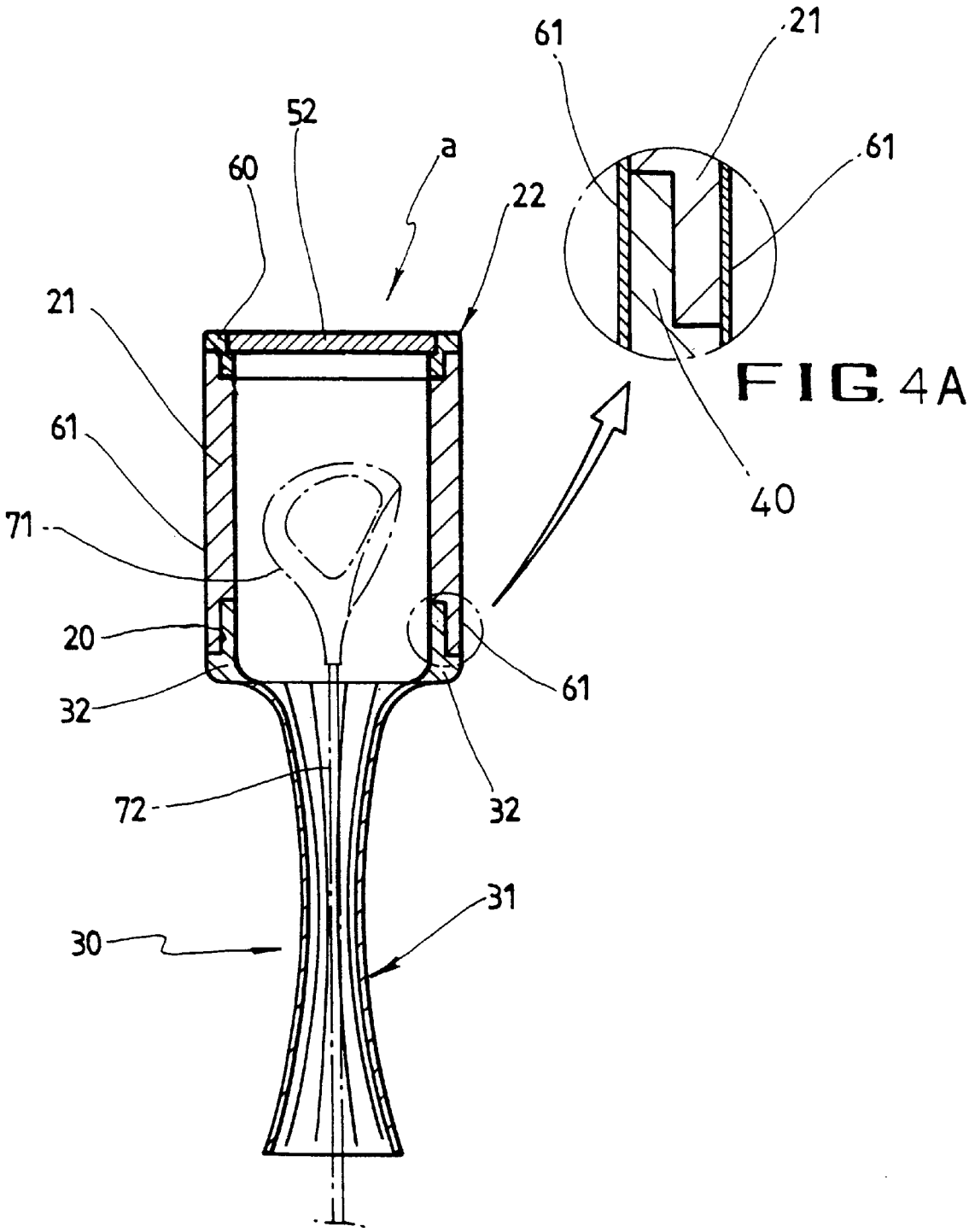
FIGS. 4 and 4A is a longitudinal-sectioned view, showing the head cover of FIG. 2, with the parts being completely assembled into a single body.

FIG. 2 is an exploded perspective view, showing the order of assembling the parts of a head cover according to the primary embodiment of this invention. FIG. 3 is a partially broken perspective view of a tubular member of the head cover of FIG. 2. FIG. 4 is a longitudinal-sectioned view, showing the head cover of FIG. 2, with the parts being completely assembled into a single body.

As shown in the drawings, the head cover according to the primary embodiment of this invention comprises a tubular member 21 used as a head protection part, which receives and protects both a club head and the head end portion of a club shaft. The above tubular member 21 defines a head pocket 10 therein, thus receiving the club head in the pocket 10 to protect the head from external impact. Both ends of the above tubular member 21 are opened, thus having first and second openings 11 and 20. A cap member 22 is detachably mounted to the edge of the first opening 11 of the tubular member 21, thereby closing the opening 11. A guide member 30 is detachably assembled with the edge of the second opening 20 of the tubular member 21. The above guide member 30 is designed to be expandable and contractible, and has a predetermined length. The guide member 30 guides entrance and exit of the club head relative to the head pocket 10, and protects the head end portion of the club shaft with the head being seated in the pocket 10.

The above guide member 30 comprises a shaft protection part 31 and a shaft ring 32. The shaft protection part 31 is designed to be expandable and contractible so as to guide the entrance and exit of the club head relative to the head pocket 10 and to receive and protect the head end portion of the shaft. The shaft protection part 31 is elastically enlarged in its diameter when a large-sized head passes through the part 31. The part 31 is also elastically reduced in its diameter to a size similar to the diameter of the shaft when the head is completely seated in the head pocket 10. The shaft ring 32 is integrated with the shaft protection part 31 and is detachably mounted to the edge of the second opening 20 of the tubular member 21. In such a case, the shaft ring 32 is brought into frictional contact with the edge of the second opening 20. In the preferred embodiment, the outer diameter of the shaft ring 32 is designed to allow the shaft ring 32 to be fitted into the second opening 20 while being brought into frictional contact with the opening 20 and being almost completely prevented from being unexpectedly removed from the opening 20. In the present invention, it is preferable to provide a locking means (not shown, for example, a kind of adhesive) at the junction between the second opening 20 and the shaft ring 32, thus retaining a frictional engagement between the opening 20 and the ring 32.

On the other hand, the tubular member 21 comprises a shape retaining frame 40, which is detachably assembled with the cap member 22 to define the head pocket 10 therein while retaining both the desired size and the desired shape of the pocket 10. A cloth part 61 is individually provided on each of the internal and external surfaces of the frame 40. The cloth part 61, provided on the internal surface of the frame 40, is made of cushionable woven fabric or synthetic fabric, thus cushioning and protecting the head from damage caused by external impact. The cloth part 61, provided on the external surface of the frame 40, is made of woven fabric or synthetic fabric capable of giving a good appearance to the head cover.

The above shape retaining frame 40 comprises a first annular frame part 41 used for forming the first opening 11 of the tubular member 21 while retaining the desired shape of the first opening 11. The frame 40 also has a second annular frame part 50 having a shape and size similar to that of the first annular frame part 41. The above second frame part 50 is used for forming the second opening 20 of the tubular member 21 while retaining the desired shape of the second opening 20. A plurality of connection parts 51 connect the first and second annular frame parts 41 and 50 to each other while retaining the spaced position of the two frame parts 41 and 50 while changing the position. The above connection parts 51 form the head pocket 10 within the tubular member 21.

On the other hand, the cap member 22 comprises a cap frame 60, which is assembled with the edge of the first opening 11 of the tubular member 21 by being brought into frictional contact with the edge of the first opening 11. A window 52, having a predetermined size, is provided on the cap frame 60 at a predetermined position for allowing the interior of the tubular member 21 to be observable from the outside of the cap member 22. A cloth part 61 is provided on the cap frame 60 for covering the interior and exterior surfaces of the cap frame 60. The above window 60 is made of a transparent material allowing a user to observe the interior of the tubular member 21 from the outside of the cap member 22.

When the cloth part 61 is made of knit, the part 61 may be preferably integrated with the external and internal surfaces of the tubular member 21. However, it should be understood that the part 61 may be also produced by flocking, sewing or bonding a cushionable material to the external and internal surfaces of the tubular member 21 without affecting the functioning of this invention.

Figure 5:
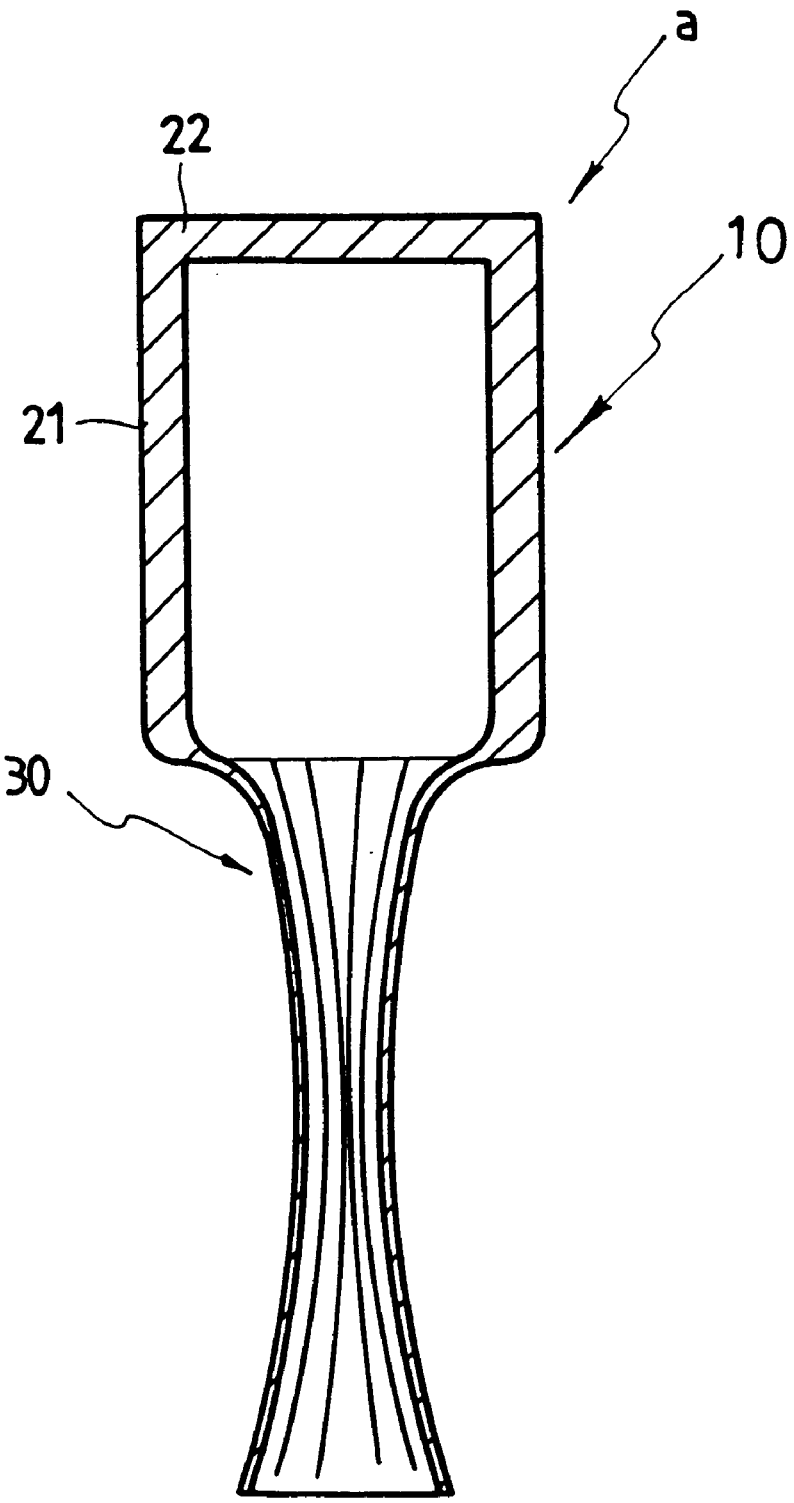
FIG. 5 is a longitudinal-sectioned view of a head cover in accordance with the second embodiment of this invention.

FIG. 5 is a longitudinal-sectioned view of a head cover in accordance with the second embodiment of this invention. In the second embodiment, the tubular member 21, the cap member 22 and the guide member 30 are integrally formed in a single structure through an injection molding process using at least one of Styrofoam, foam and/or plastic.

In the head cover of this invention, the shape retaining frame 40 of the tubular member 21 is integrally formed through an injection molding process. The above frame 40 is, thereafter, assembled with the cap member 22 at its upper end and with the guide member 30 at its lower end. In such a case, the shape retaining frame 40 of the tubular member 21, the cap frame 60 of the cap member 22, and the shaft ring 32 of the guide member 30 are simply and easily produced through an injection molding process, and so it is possible to variously design their size and shape. This finally allows a variety of head covers, having various shapes and various sizes, to be easily and simply produced. In addition, it is possible to reduce time while designing and producing the head covers for golf clubs, thus improving productivity and reducing the production cost of the head covers.

As described above, the present invention provides a head cover for golf clubs. The head covers of this invention may be easily and simply produced even by unskilled workers without consuming significant time, and so it is possible to improve productivity and to reduce the production cost of the head covers.

In the head cover of this invention, the shape retaining frame of the tubular member, the cap frame of the cap member, and the shaft ring of the guide member are simply and easily produced through an injection molding process. Therefore, it is possible to variously design the size and shape of the head cover. This finally allows a variety of head covers, having various shapes and various sizes, to be easily and simply produced, with such head covers meeting the various requirements of golfers.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A head cover for receiving and protecting both a head and a head end portion of a shaft of a golf club, the head cover comprising:

a tubular member having a head pocket for protecting said head from an impact by receiving said head, and a first opening and a second opening being formed at both ends of said head pocket;

a cap member detachably mounted to an edge of said first opening which protects detachment of said head received in said head pocket toward said first opening; and a flexible guide member for guiding an entrance and exit of said head toward said head pockets by assembling an edge of said second opening to be formed by a contracted diameter by expansion and contraction operation.

2. The head cover according to claim 1, wherein said tubular member comprises:

a shape retaining frame, assembled with said cap member, for forming a basic shape to maintain a specific shape of said head pocket; and a cloth part formed on at least one end of an internal side surface and an external side surface of said shape retaining frame.

3. The head cover according to claim 2, wherein said shape retaining frame comprises:

a first annular frame part used for forming said first opening of the tubular member while retaining a shape of the first opening;

a second annular frame part used for forming said second opening of the tubular member while retaining a shape of said second opening; and at least one connection part used for connecting said first and second annular frame parts to each other while retaining positions of the two frame parts.

4. The head cover of claim 1, wherein said tubular member, said cap member, and said guide member are integrally formed in a single structure by a molding process, and formed using at least one of Styrofoam, foam and/or plastic.

5. The head cover of claim 1, wherein said guide member comprising:

a guide cover for guiding the entrance and exit of said head and performing an expansion and contraction operation between the contracted diameter and an expanded diameter to protect a separation of said head; and a cover ring formed in a body and assembled with the edge of said second opening.

6. The head cover of claim 5, wherein at least one end of said second opening and said cover ring is frictionally contacted with the other end of said second opening and said cover ring to be a fixed assembly.

7. The head cover according to claim 1, wherein said cap member comprises:

a cap frame assembled with the edge of said first opening of the tubular member by being brought into frictional contact with said edge of the first opening, with a window being provided on the cap frame for allowing the interior of said tubular member to be observable from the outside of said cap member; and a cloth part provided on said cap frame for covering interior and exterior surfaces of said cap frame.

8. The head cover according to claim 7, wherein said window is made of a transparent material.

* * * * *